US006401772B1

(12) United States Patent
Beitl

(10) Patent No.: US 6,401,772 B1
(45) Date of Patent: Jun. 11, 2002

(54) SYSTEM AND METHOD FOR FORMING DOVETAIL JOINTS

(76) Inventor: Terry J. Beitl, 6837 Groveland Rd., Pipersville, PA (US) 18947

( * ) Notice: Subject to any disclaimer, the term of this patent is extended or adjusted under 35 U.S.C. 154(b) by 0 days.

(21) Appl. No.: 09/538,430

(22) Filed: Mar. 29, 2000

(51) Int. Cl.[7] ..... B27C 1/00; B27C 3/00; B27F 5/10

(52) U.S. Cl. ..... 144/365; 108/6; 144/74; 144/78; 144/84; 144/91.2; 144/92; 144/69; 144/335; 144/367; 144/371; 144/219; 144/240; 144/85; 408/30; 408/165; 408/712

(58) Field of Search ..... 408/30, 164, 165, 408/203.5, 204, 205, 712; 108/6; 144/218, 219, 1.1, 3.5, 74, 75, 78, 84, 85, 87, 88, 82, 90.1, 91, 91.2, 92, 93.1, 335, 365, 367, 371; 269/69, 289 R

(56) References Cited

U.S. PATENT DOCUMENTS

| | | | | | |
|---|---|---|---|---|---|
| 27,782 | A | | 4/1860 | Eames | 408/30 |
| 283,341 | A | * | 8/1883 | Greenlee | 144/78 |
| 788,941 | A | | 5/1905 | Pearl | 408/25 |
| 1,560,105 | A | * | 11/1925 | See | 144/69 |
| 1,963,611 | A | | 6/1934 | Brumell et al. | 144/219 |
| 2,214,663 | A | * | 9/1940 | Dewey | 144/84 X |
| 2,821,218 | A | | 1/1958 | Hultquist | 144/78 |
| 2,852,050 | A | * | 9/1958 | Horstmann et al. | 144/92 |
| 2,963,057 | A | * | 12/1960 | Morse | 144/92 X |
| 2,996,090 | A | | 8/1961 | Smith | 144/79 |
| 4,753,558 | A | | 6/1988 | Jansson | 408/212 |
| 4,943,040 | A | * | 7/1990 | Finstad et al. | 269/69 |
| 5,297,903 | A | * | 3/1994 | Hilton | 408/30 |
| 5,507,331 | A | | 4/1996 | Nakanishi | 144/371 |
| 5,562,135 | A | | 10/1996 | Beth et al. | 144/1.1 |

FOREIGN PATENT DOCUMENTS

| | | | | |
|---|---|---|---|---|
| DK | 10996 | * | 6/1908 | 144/78 |
| DK | 32944 | * | 2/1924 | 144/78 |
| IT | 547726 | | 11/1955 | |
| RU | 74685 | | 2/1945 | |

OTHER PUBLICATIONS

One (1) Sheet of drawing from German Patent No. 97,991 which shows different cutter heads.

* cited by examiner

*Primary Examiner*—W. Donald Bray
(74) *Attorney, Agent, or Firm*—Woodcock Washburn LLP

(57) ABSTRACT

An apparatus for cutting dovetail joints comprises one or more trapezoidal mortising chisels mountable on a drill press, each trapezoidal mortising chisel having a trapezoidal cross sectional shape with a particular slope or "pitch" on its non-parallel sides. The trapezoidal mortising chisels are used to cut sockets in the tail board of a dovetail joints, where the sockets have a trapezoidal shape with sloped sides. A given slope can be selected for the sides of the sockets by selecting a trapezoidal mortising chisel having the given slope. A washer is also provided which is mountable about the tilt axis of a tiltable work table of the drill press. The washer has a set of holes located at an angle about the washer on either side of a reference radius, where the angle correspond to the slopes of the non-parallel sides of the trapezoidal mortising chisels. When the washer is mounted about the tilt axis of the work table, it aligns the work table in a position tilted at an angle corresponding to corresponding to the slope of a side of a socket in the tail board. In this tilted position, a standard square mortising chisel can be used to cut slanted sockets in the pin board of the dovetail joint.

32 Claims, 15 Drawing Sheets

SYSTEM AND METHOD FOR FORMING DOVETAIL JOINTS

FIELD OF THE INVENTION

The present invention relates generally to the field of woodworking, and, more particularly, to a system and method for forming dovetail joints.

BACKGROUND OF THE INVENTION

Dovetails are used in carpentry and cabinetry to join two wooden boards together at 90 degree angles. One board, called the tail board, has sockets cut in a trapezoidal (i.e., dovetail) shape, with "tails" being formed in between the sockets. The other board, called the pin board, has pins cut to fit in the sockets. When the two boards are joined together, the result is a durable, eye-pleasing joint.

Dovetails have traditionally been cut by hand with a saw and a chisel —a process involving much time and skill. A number of devices have been created to simplify the process of cutting dovetails. A typical dovetail-cutting device uses a set of templates (or "jigs") and a specially designed set of router bits. By positioning the templates over the pin board and tail board and guiding a router fitted with the special router bit through the templates, it is possible to cut dovetails. This method, however, has drawbacks, such as a large amount of router noise and dust, and the possibility that the wood will be torn during the routing process. Additionally, due to the limited sizes and configurations of the templates and router bits, these devices can generally be used only to cut dovetails for boards up to 24 inches long with pins spaced no more than ¾-inches apart, and can usually be used to form only "half-blind" or "lap" style dovetails (dovetails in which the pin board is not cut all the way through its thickness). Still further, assembling, aligning and attaching the templates over the pin and tail boards can be a time-consuming process. Finally, the templates can only be used to cut uniformly spaced and sized pins and tails, which do not display the individual and unique variations in shape and size that are characteristic of fine woodworking.

In view of the foregoing, there is a need for a system for forming dovetail joints that overcomes the limitations and drawbacks of the prior art.

SUMMARY OF THE INVENTION

A system according to the present invention may be used to cut dovetail joints with sockets having arbitrary and non-uniform sizes and pitches. The system may also be used to cut dovetails in wooden boards having arbitrary lengths and thicknesses.

In accordance with the invention, a trapezoidal hollow mortising chisel is provided, which is mounted on a drill press for cutting the tail board of a dovetail joint. The trapezoidal mortising chisel has a guide tube with a trapezoidal cross-section, and a drill bit mounted in the center of a guide tube. When attached to a drill press, the trapezoidal mortising chisel may be used to make a trapezoidal cut through a wooden board. Each socket in the tail board has two slanted sides, which correspond to the non-parallel sides of the trapezoid that defines the shape of the guide tube. Thus, the trapezoidal mortising chisel may be used to cut tail board sockets, with sides having angles corresponding to the pitch of the non-parallel sides of the trapezoid.

Once the tail board has been cut, a standard square hollow mortising chisel can be mounted on a drill press for cutting the sockets in the pin board. The work table of the drill press is tilted so that, during the cutting processes, a slope can be placed on the socket, thereby allowing a tail from the tail board to fit into it. The slope corresponds to the pitch of the trapezoidal mortising chisel that was used to cut the tail board. The system includes means for aligning the tilt of the work table at an angle that corresponds to the desired pitch. Exemplary means include a circular washer, mountable about the tilt axis of the work table, where the washer has a pair of holes located on either side of a reference radius and at a given angle from the reference radius, where the reference radius corresponds to the horizontal (non-tilted) position of the work table. The holes receive the alignment pin of a drill press, thereby allowing the work table to be aligned at the given angle of tilt.

Other features of the invention are described below.

BRIEF DESCRIPTION OF THE DRAWINGS

The foregoing summary, as well as the following detailed description of preferred embodiments, is better understood when read in conjunction with the appended drawings. For the purpose of illustrating the invention, there is shown in the drawings exemplary constructions of the invention; however, the invention is not limited to the specific methods and instrumentalities disclosed. In the drawings.

DETAILED DESCRIPTION OF THE INVENTION

Figure 2:
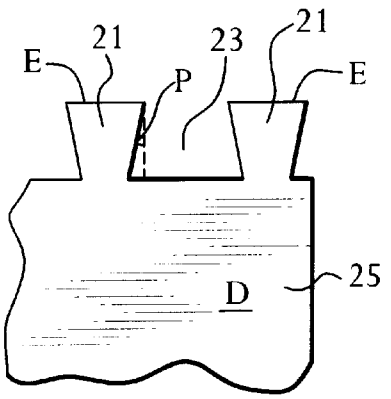
FIG. 2 is a plan view of face D of the tail board of the dovetail joint shown in FIG. A.
Figure 3:
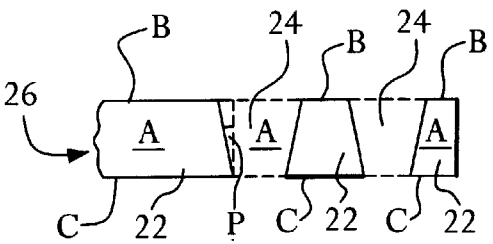
FIG. 3 is a plan view of face A of the pin board of the dovetail joint shown in FIG. A.
Figure 1:
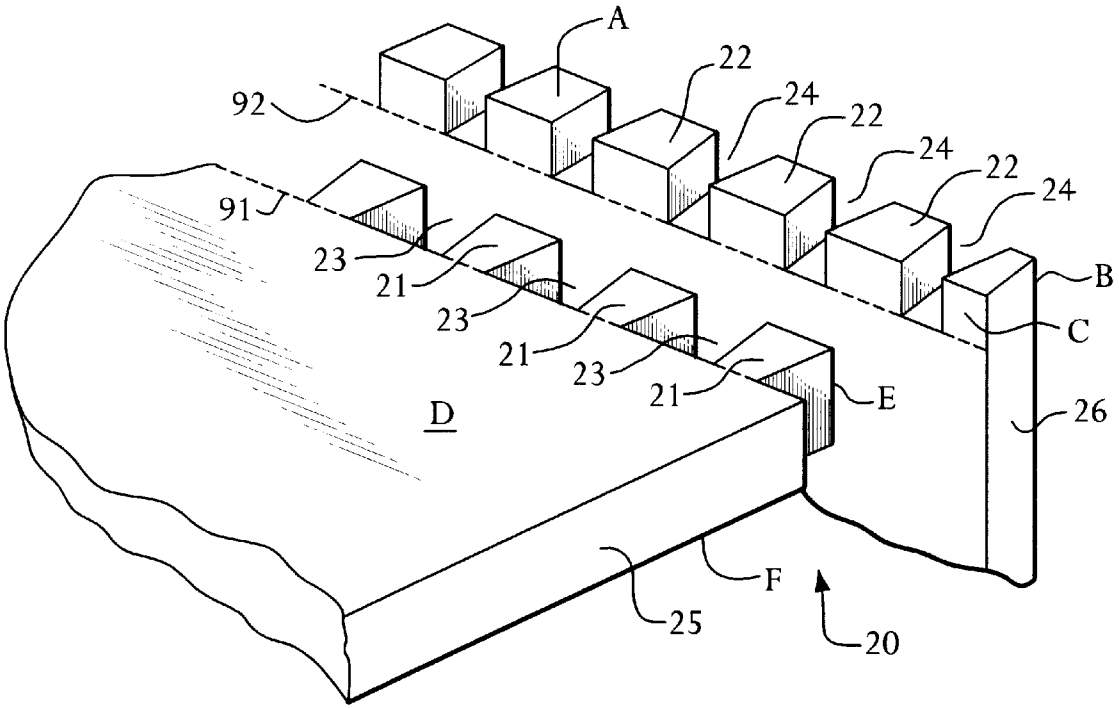
FIG. 1 is a perspective view of the tail board and pin board of a through dovetail joint, with letters A-F indicating faces of the pin board and tail board.

Referring to the drawings wherein like numerals are used to indicate like elements throughout, there is shown in FIG. 1 a tail board 25 and a pin board 26 of an exemplary dovetail joint 20. The end of tail board 25 has a plurality of tails 21. Tails 21 are defined by pin sockets 23 into which pins are received. The end of pin board 26 has a plurality of pins 22. Pins 22 are defined by tail sockets 24 into which tails 21 are received. As shown in FIGS. 2 and 3, the sides of the tails 21 and pins 22 are not square, but rather slanted at an angle or "pitch" P. Specifically, the sides of tails 21 are slanted an angle P to the plane of end surface E of tail board 25. Similarly, the sides of pins 22 are slanted at an angle P to the plane of end surface C of tail board 26. Because both tails 21 and pins 22 are slanted at the same angle P, they can be fit together, such that tails 21 can be received in sockets 24 of pin board 26, and pins 22 can be received in sockets 23 of tail board 25. Joining the pin board and tail board in this manner creates a strong joint for use in cabinetry or other woodworking applications, because the slanted shape of the pins and tails prevents them from coming apart under normal force or movement.

Figure 4:
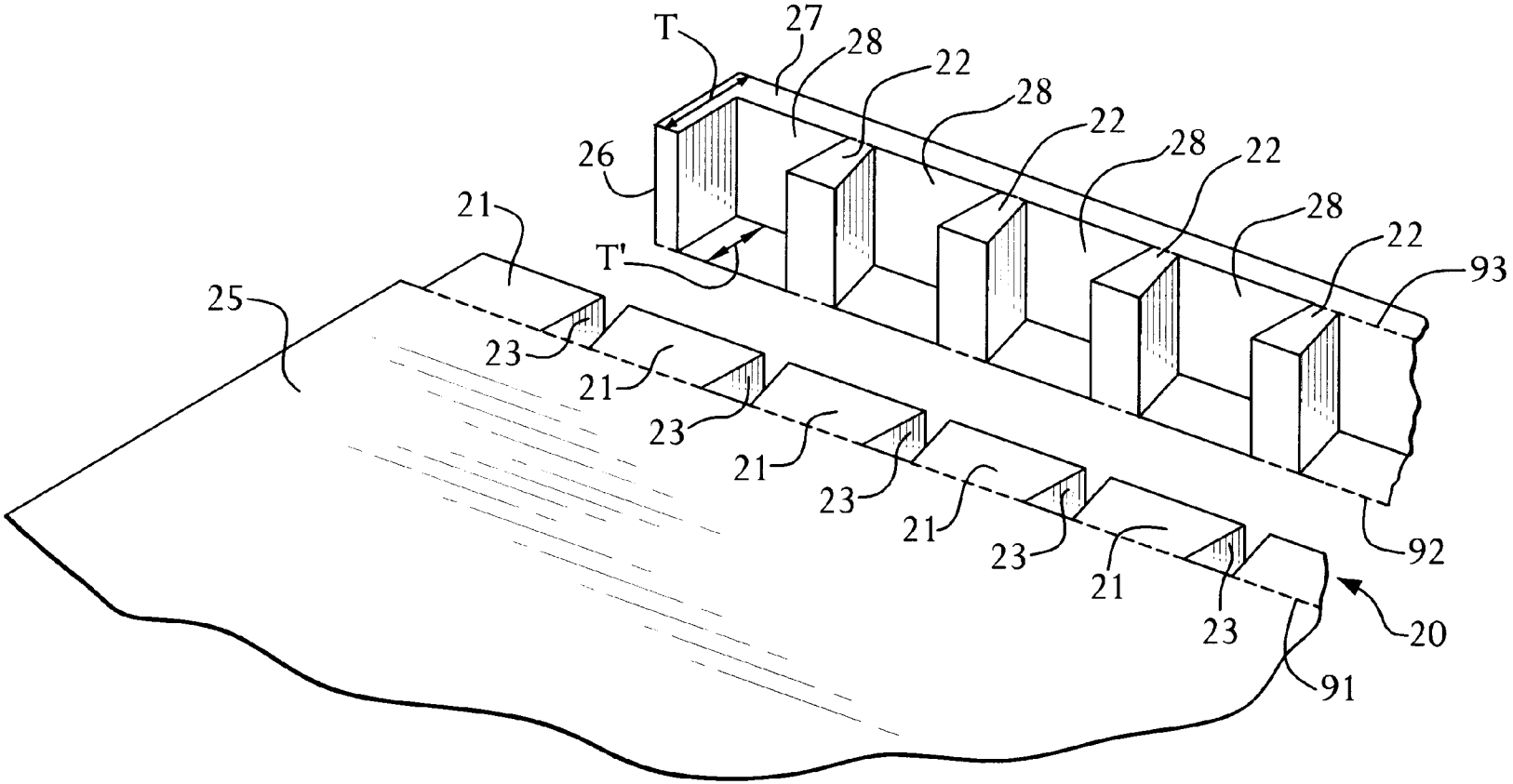
FIG. 4 is a perspective view of the pin board and tail board of a lap dovetail joint.
Figure 5:
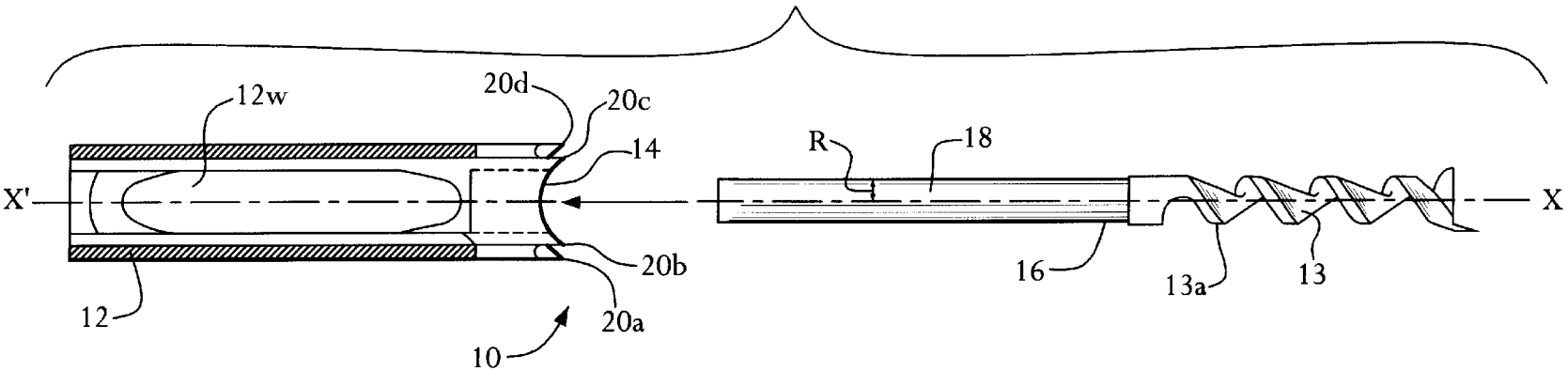
FIG. 5 is an exploded view of a trapezoidal mortising chisel in accordance with aspects of the invention.
Figure 6:
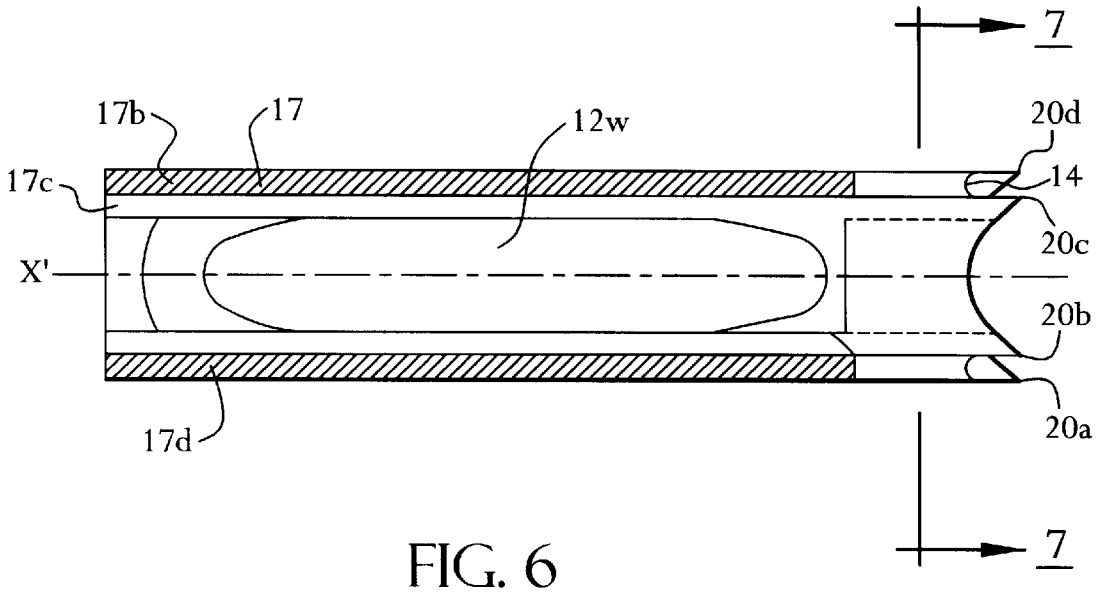
FIG. 6 is a plan view of the guide tube of a trapezoidal mortising chisel in accordance with aspects of the invention.
Figure 7:
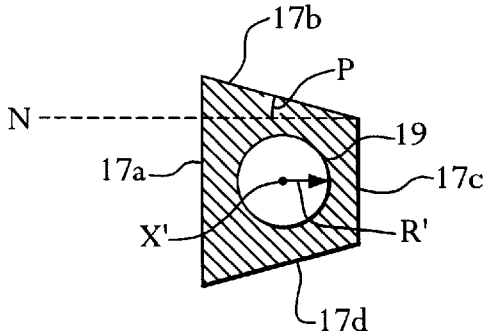
FIG. 7 is a sectional view of the guide tube shown in FIG. 6, taken along line 7—7.
Figure 7A:
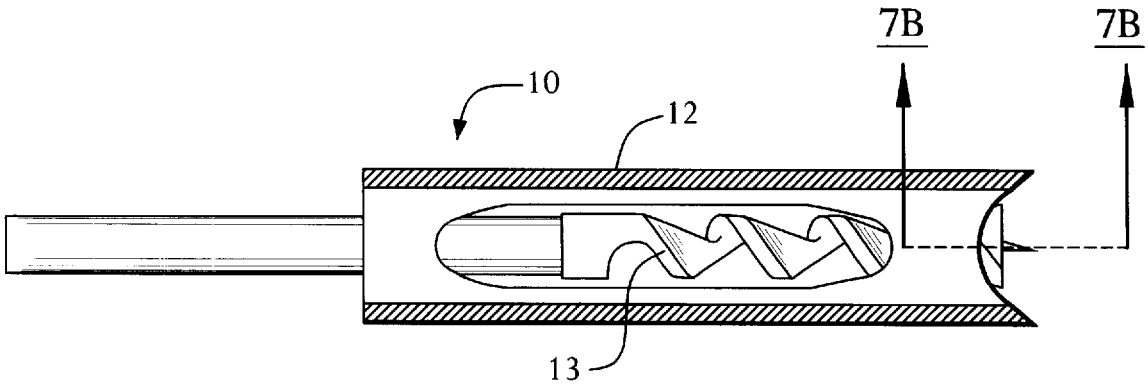
FIG. 7A is a plan view of the trapezoidal mortising chisel shown in FIG. 5, with the drill bit positioned in the guide tube.
Figure 7B:
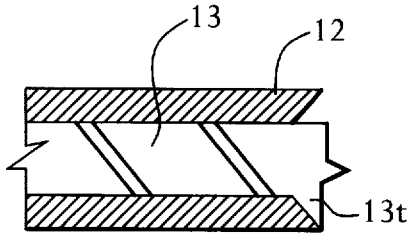
FIG. 7B is a sectional view of the trapezoidal mortising chisel shown in FIG. 7A, taken along line 7B—7B.
Figure 8:
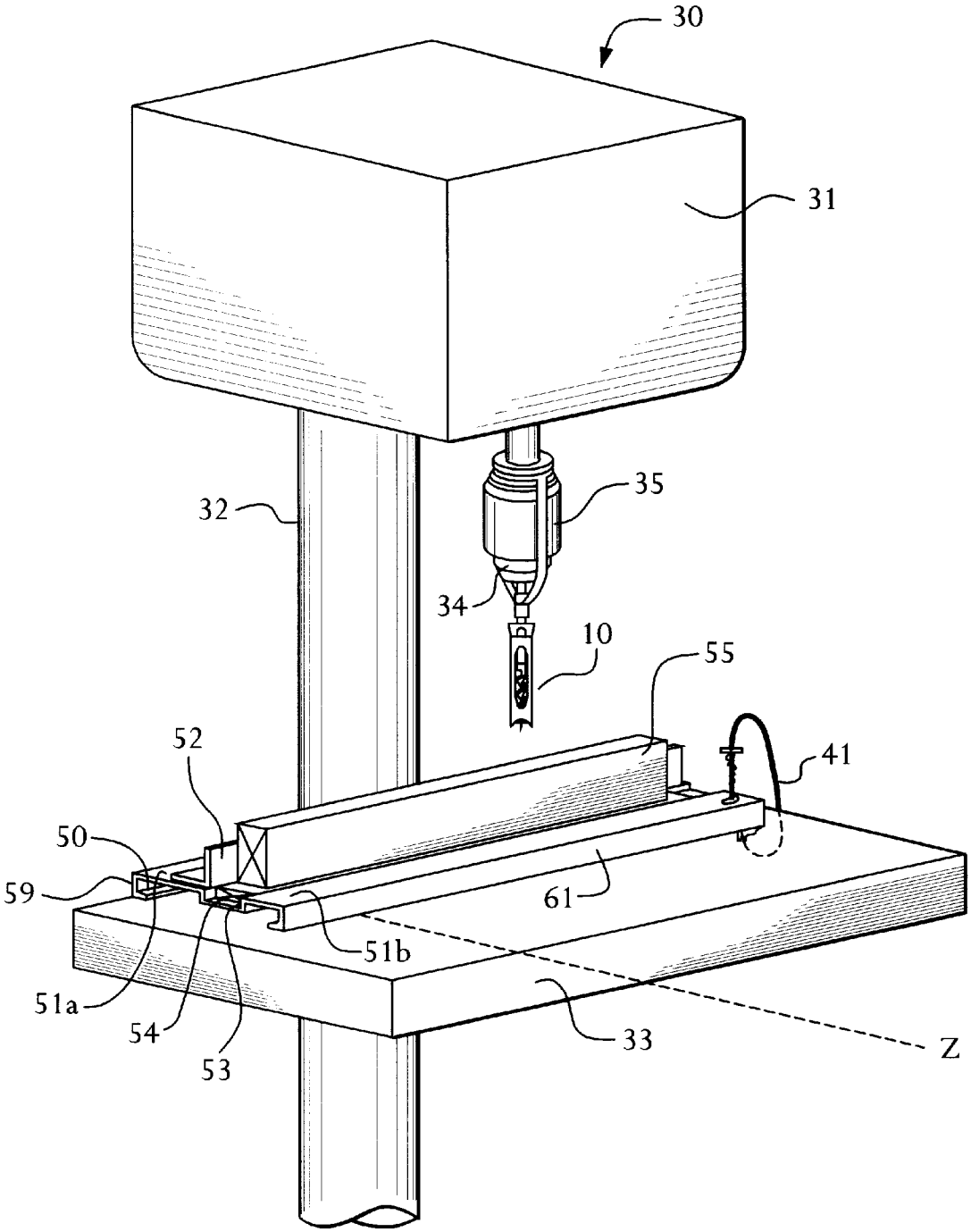
FIG. 8 is a perspective view of a drill press with a trapezoidal mortising chisel and auxiliary table in accordance with aspects of the invention mounted thereon.
Figure 9:
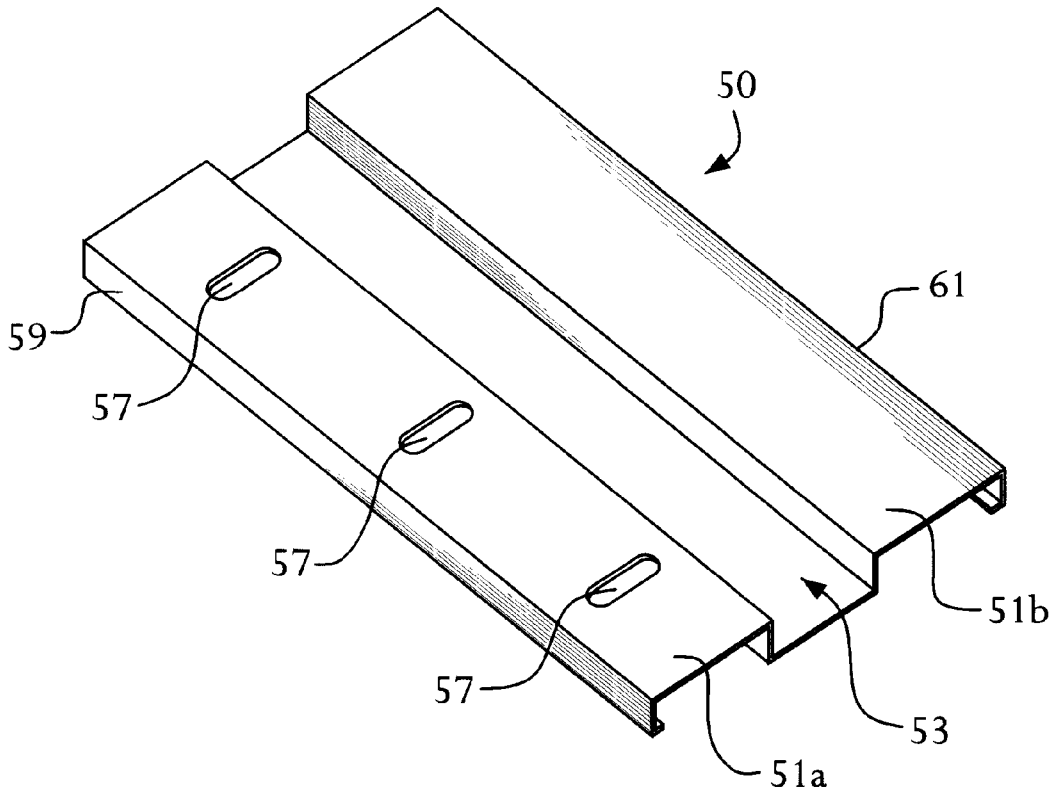
FIG. 9 is a perspective view of an auxiliary table in accordance with aspects of the invention.
Figure 10:
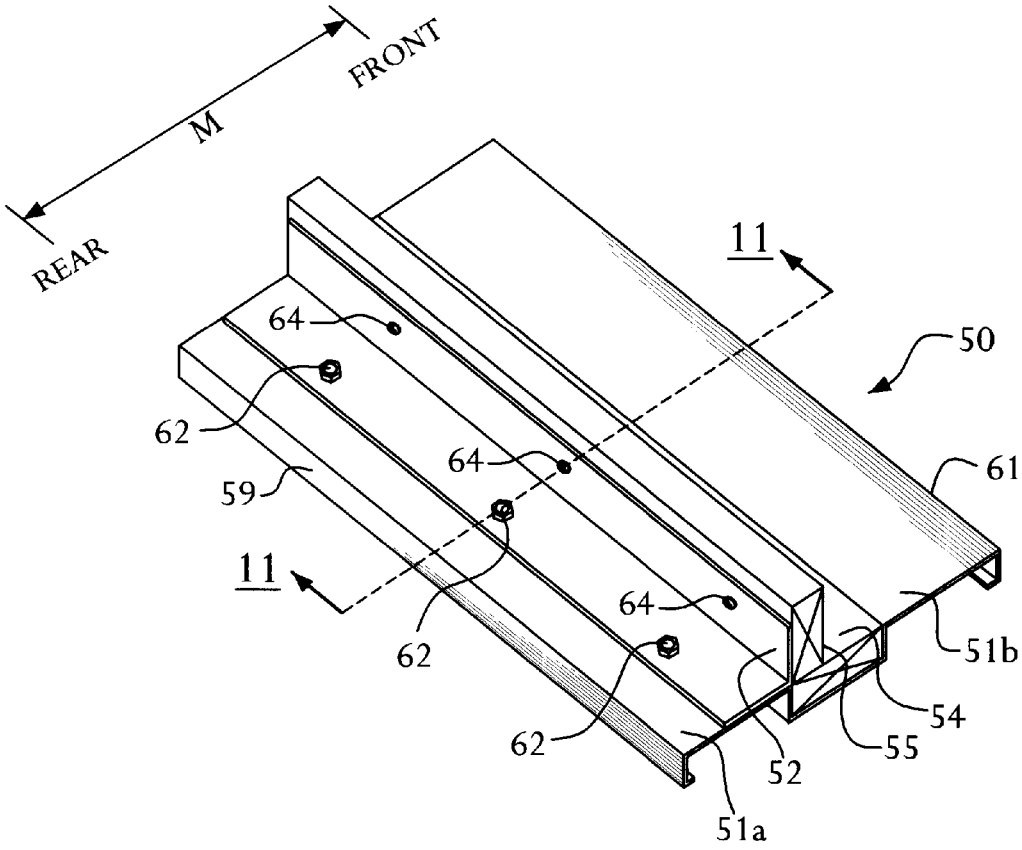
FIG. 10 is a perspective view of an auxiliary table in accordance with aspects of the invention, with back fence, wood insert, and wood face mounted thereon.
Figure 11:
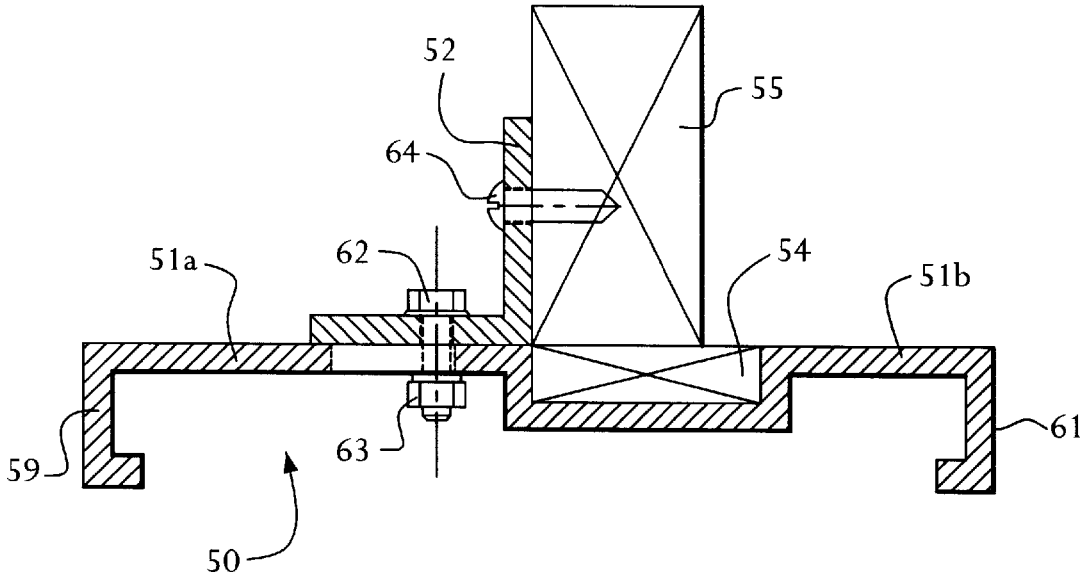
FIG. 11 is a sectional view of the auxiliary table shown in FIG. 10, taken along line 11—11.
Figure 12:
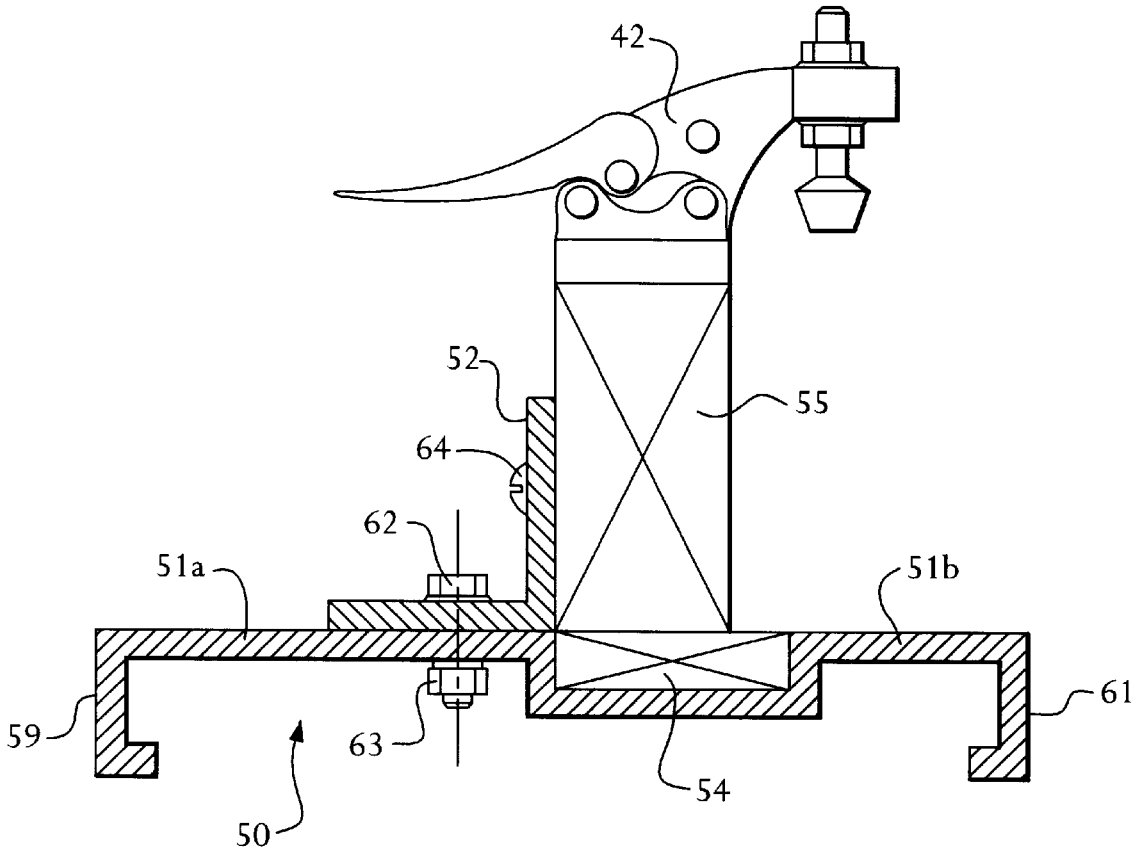
FIG. 12 is a plan view of an auxiliary table in accordance with aspects of the invention, with back fence, wood insert, wood face, and a clamp mounted thereon.
Figure 13:
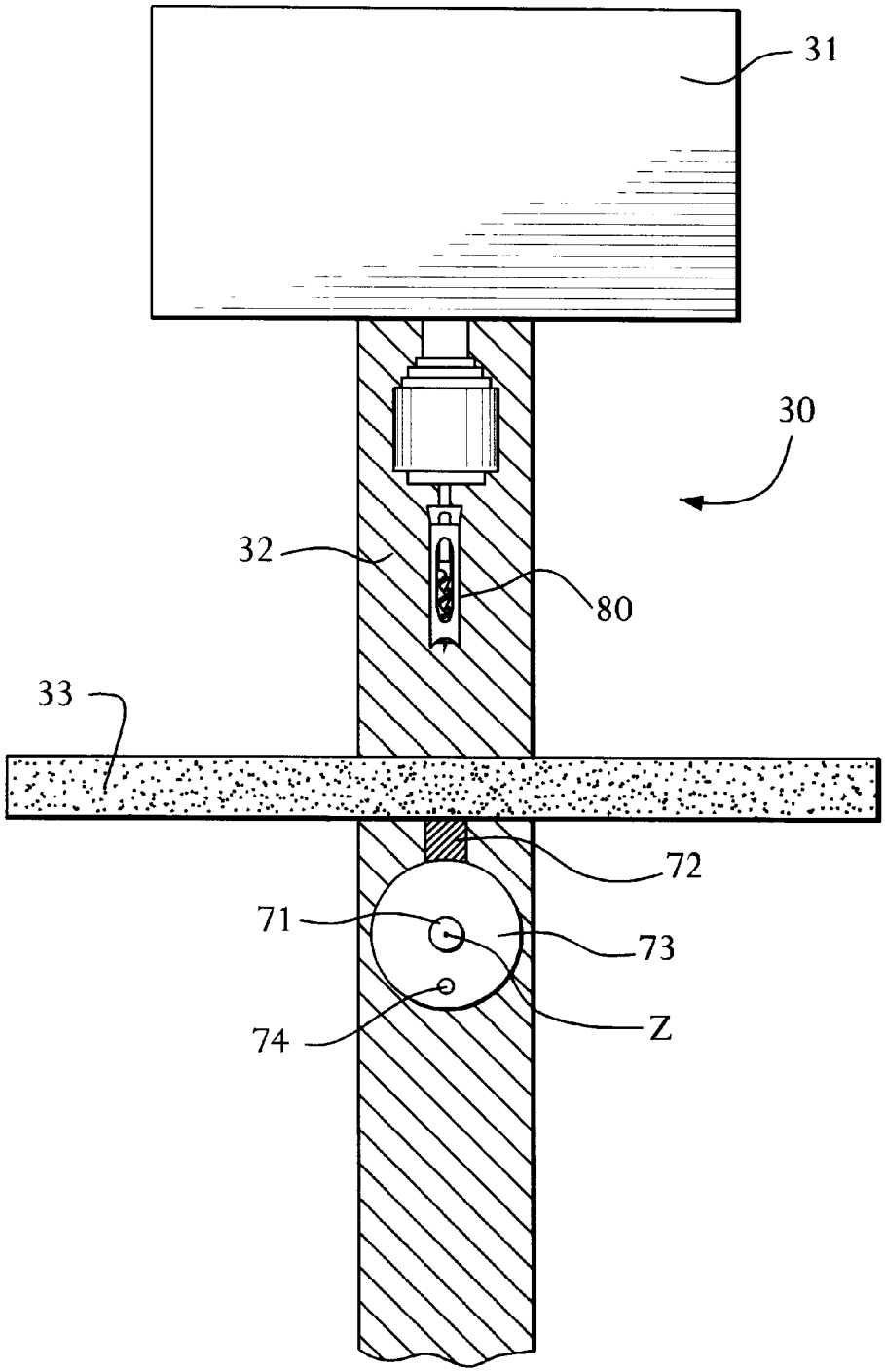
FIG. 13 is a plan view of a drill press assembly for use in accordance with aspects of the invention.
Figure 14:
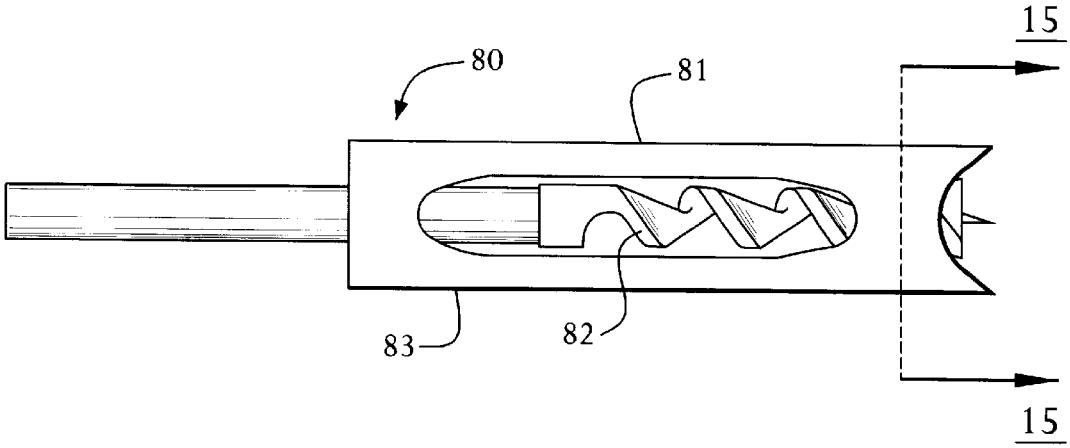
FIG. 14 is a plan view of a standard square mortising chisel for use in cutting a pin board in accordance with aspects of the invention.

Dovetail joints 20 come in two varieties: "through" dovetails, depicted in FIG. 1, where socket 24 are cut all the way through the thickness T of the pin board 26, and "lap" or "half-blind" dovetails, depicted in FIG. 4, where sockets 28 are cut less than all the way through the thickness of the pin board 26. In FIG. 4, pin board 26 has a lap 27, which represents the difference between the thickness T of the pin board 26 and the depth T' of sockets 28. The apparatus disclosed herein may be used to form either type of dovetail joint.

Referring now to FIGS. 5 through 19, a trapezoidal mortising chisel 10 for cutting the tail board of a dovetail joint 20 comprises a trapezoidal guide tube 12 and an drill bit 16. Trapezoidal guide tube 12 has a continuous cutting edge 14, which is tapered to a sharp edge, thereby allowing it to cut through wood. Guide tube 12 is preferably made of steel or another rigid metal so that it can retain its shape under the pressure of cutting through wood. Guide tube 12 has an outer surface 17 comprising four walls 17*a–d*, and an inner surface 19 which is generally tubular. The four walls 17*a–d* form the shape of a trapezoid, such that walls 17*a* and 17*c* are parallel, and walls 17*b* and 17*d* are non-parallel. Preferably, at least one of the walls has a window 12*w* to facilitate the ejection of wood chips generated by the drill bit discussed below. At least one of walls 17*b* and 17*d* are each at an angle or "pitch" P to normal line N; normal line N is perpendicular to each of parallel sides 17*a* and 17*c*. Preferably, the trapezoidal cross-sectional shape of outer surface 17 is an isosceles trapezoid, wherein both non-parallel walls 17*b* and 17*d* are sloped away from each other and at the same angle P relative to normal line N. The magnitude of angle P is preferably between 5 and 15 degrees, more preferably 7 degrees. Cutting edge 14 is scalloped, such that it terminates in four points 20*a–d*. Several trapezoidal mortising chisels 10 may be provided, each having non-parallel sides sloped at a different angle P, such as 5, 7, 9, 10, 12, and 13 degrees.

Drill bit 16 comprises a shank 18 and an auger 13. Auger 13 has an outer surface 13*a*, which extends to a radius R from the longitudinal axis X of drill bit 16. Drill bit 16 is rotatably mounted inside guide tube 12 coaxial with axis X' of circular inner surface 19. The radius R of auger 13 is approximately equal to the radius R' of the circle defining circular inner surface 19, such that the inner surface 19 of guide tube 12 can physically accommodate drill bit 16, but drill bit 16 can rotate inside guide tube 12 with little or no play. Preferably, auger 13 has a wide end 13*t*, which is wider than radius R for at least some of the circumference of auger 13. The additional width of wide end 13*t* holds drill bit 16 in place longitudinally relative to guide tube 12, so that drill bit 16 does not slide up guide tube 12 while trapezoidal mortising chisel 10 is being used to cut a tail board.

An exemplary drill press assembly 30 for use with the invention comprises a column 32, a power head 31 mounted on column 32, and a work table 33 tiltably mounted on column 32. The power head 31 contains an electric motor (not shown) which can be used to provide power for a variety of tools, such as trapezoidal mortising chisel 10. A drill chuck 35 is attached to the power head 31 and motor, and provides a mounting interface for tools to be attached to drill press 30. By turning on the motor and manually moving power head 31 downward along column 32, drill press 30 can provide torque and vertical force to an attached tool.

An auxiliary table 50 is non-movably and demountably mounted to work table 33 of drill press 30 by means such as one or more C-clamps 41. Auxiliary table 50 comprises two raised portions 51*a* and 51*b*, a track 53 between raised portions 51*a* and 51*b*, and a back fence 52. Track 53 receives replaceable wood insert 54, on top of which tail board 25 or pin board 26 will be positioned for cutting by a drill press tool attachment, such as trapezoidal mortising chisel 10 or standard mortising chisel 80. Raised portions 51*a* and 51*b*, track 53, and back fence 52 are preferably made of steel or another metal sufficiently rigid to keep the surface of the wood insert 54 remains at a right angle to the back fence 52 while a board is being cut on the auxiliary table 50. A purpose of replaceable wood insert 54 is to provide a cuttable wood surface into which a woodworking tool such as trapezoidal mortising chisel 10 can descend as it cuts a wooden board, such as tail board 25; if tail board 25 were placed directly on a metal surface as it was being cut, a woodworking tool could be stopped by the metal surface before it had finished cutting the wood. For example, if a tail board 25 to be cut by trapezoidal mortising chisel 10 were placed directly on a metal surface, trapezoidal mortising chisel would stop descending as soon as points 20*a–d* had come into contact with the metal surface, which would occur before trapezoidal mortising chisel 10 had cut all the way through tail board 25.

Raised portion 51*a* of auxiliary table 50 has a set of slits 57, which receive bolts 62. Back fence 52 is slidably secured to raised portion 51*a* by bolts 62 and nuts 63. When bolts 62 and nuts 63 are in a loosened position, it is possible to slide back fence 52 frontward (toward front side 61 of auxiliary table 50) or rearward (toward rear side 59 of auxiliary table 60) relative to auxiliary table 50 along axis M. When bolts 62 and nuts 63 are tightened, back fence 52 is secured in position relative to auxiliary table 50. A replaceable wood face 55 is fixedly and removably attached to back fence 52 by a set of screws 64. When replaceable wood face 55 and back fence 52 are secured in position by the tightening of bolts 62 and nuts 63, a wooden board, such as tail board 25 or pin board 26 can be positioned on auxiliary table 50 for cutting on drill press 30 by pushing it against wood face 55, where it can then be held in position by means of a conventional clamp 42 mounted to wood face 55, as discussed below. Wood face 55, which may become worn or damaged over time, can be replaced by unscrewing it from back fence 52 and attaching a new wood face 55 with screws 64.

The work table 33 of drill press assembly 30 is tiltable about a rotational axis Z so that anything on work table 33, such as a wooden board and/or auxiliary table 50 may be tilted as it is being cut by a tool attached to power head 31. Tiltability is typically accomplished by means of a bolt 71 on which work table 33 is rotatably mounted to collar 32*c*on column 32 about axis Z. In an exemplary structure shown in FIG. 13, bracket 72 connects work table 33 to disk 73, and is attached both to work table 33 and to disk 73. Bracket 72 is either fixedly attached to work table 33, or, alternatively, work table 33 is rotatably mounted on bracket 72 so as to rotate about axis Y. Bolt 71 is received through the center hole 73*h* of disk 73 and in a hole 77 in collar 32*c* of column 32, thereby allowing work table 33 to be tiltably mounted on column 32. The longitudinal axis of bolt 71 coincides with axis Z, so that work table 33 rotates about axis Z by rotating about bolt 71. Bolt 71 may be loosened (to permit work table 33 to be tilted) or tightened (to hold work table 33 in position). In a typical drill press assembly, disk 73 has a single alignment pin hole 74 which receives alignment pin 79. When work table 33 is in the horizontal position (i.e., zero degrees of tilt), alignment pin hole 74 aligns with a second hole 78 in collar 32*c* of column 32; in this position, alignment pin 79 may be received through both holes, thereby aligning work table 33 in the horizontal position. When so aligned, bolt 71 may be tightened to hold work table 33 in the horizontal position.

Figure 18:
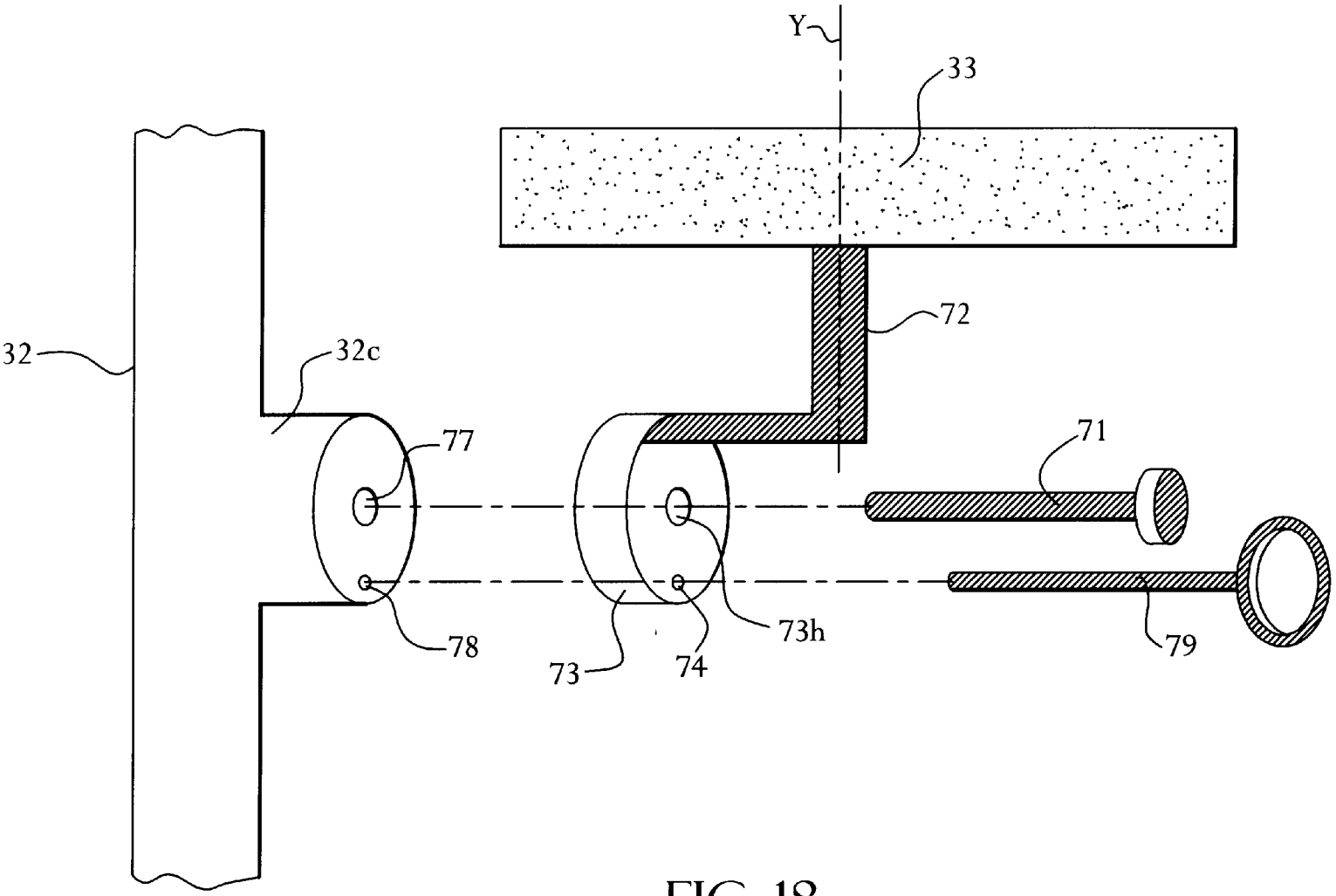
FIG. 18 is an exploded view of a portion of the drill press assembly shown in FIG. 13, showing the means by which the table is mounted to the column.
Figure 19:
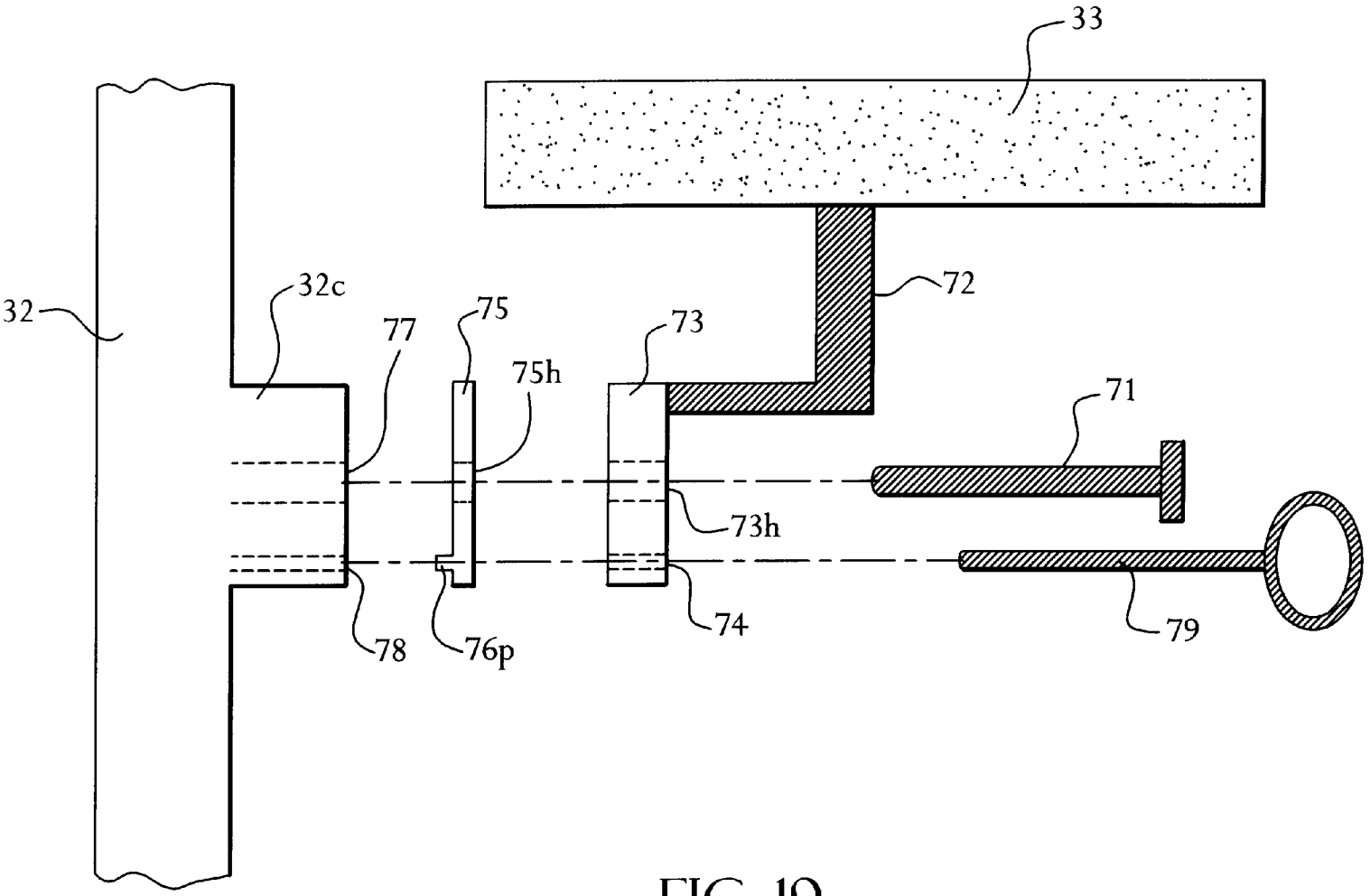
FIG. 19 is an exploded view of the portion of the drill press assembly shown in FIG. 18, showing the addition of the washer depicted in FIG. 16 as a tilt-aligner mechanism.

In accordance with an aspect of the invention, a washer 75 is provided which is fitted over collar 32*c*, as shown in FIG. 19. Washer 75 provides two alignment pin holes 76 located at an angle P' about washer 75 relative to a reference starting radius R(0). A pin 76*p* is located along the reference starting radius R(0), which corresponds to the horizontal position of work table 33. Drill press assembly 30 is fitted with washer 75 by removing disk 73 (along with bracket 72 and work table 33) and inserting washer 75 between collar 32*c* and disk 73, and inserting pin 76*p* into hole 78 of collar 32*c*. Disk 73 is then reinstalled by fitting bolt 71 first through disk 73, then through center hole 75*h* in washer 75, and then through hole 77 in collar 32, as shown in FIG. 18. Because pin 76*p* of washer 75 now blocks hole 78, which normally receives alignment pin 79 in an unmodified drill press, it is not possible to insert alignment pin 79 through hole 78 when washer 75 is installed. However, alignment pin 79 can be fitted through hole 74 in disk 73 and then through one of the holes 76 in washer 75, which has the effect of aligning work table 33 in a position titled at an angle P'. In this tilted position, bolt 71 can be tightened to hold work table 33 at angle P'.

For reasons that are discussed below, angle P' corresponds to an angle P for a particular trapezoidal mortising chisel 10, such that work table 33 can be held in a tilted position at an angle P' corresponding to the angle P of a given trapezoidal mortising chisel 10. If several trapezoidal mortising chisels 10 are provided, each having a pitch of P, then several washers 75 may be provided, where each has holes at a different angle P' relative to reference radius R(0). Work table 33 may be aligned at an angle of tilt P' by inserting alignment pin 79 through hole 74 in disk 73, and through one of the holes 76 in washer 75. In one embodiment of the invention, washer 75 is provided as separate part to be fitted over collar 32*c* in a standard drill press 30. In another embodiment of the invention, a specialized drill press 30 is provided as a dedicated dovetail cutting machine, which comes fitted with washer 75.

The process will now be described by which the above-described elements may be used to cut the tail board 25 and pin board 26 of a dovetail joint.

First, auxiliary table 50 is mounted on work table 33 of drill press 30, and secured to work table 33 by clamps 41 or by other means. Auxiliary table 50 may be fitted with replaceable wood insert 54 and replaceable wood face 55 at this time. Next, trapezoidal mortising chisel 10 is mounted on drill press 30. The mounting of trapezoidal mortising chisel 10 is such that drill bit 16 can be rotated by the motor contained within power head 31 but such that guide tube 12 does not rotate. Guide tube 12 is fixed in orientation such that wall 17*c*, the shorter of the two parallel walls 17*a* and 17*c*, is positioned toward the rear of auxiliary table 50. The choice of this orientation is due to the fact that the end E of tail board 25 will also be toward the rear of auxiliary table 50 during the cutting process, and a typical tail socket is narrower toward the end E of the tail board 25, and wider toward the interior of the tail board 25. Trapezoidal mortising chisel 10 will be used to cut the sockets 23 in tail board 25.

Next, a scribe line 91 is marked in tail board 25. Scribe line 91 is drawn at a distance from the end of tail board 25 which corresponds to the thickness T of the pin board 26 (in the case where through dovetails are to be made) or a lesser distance T' (in the case where lap dovetails are to be made). Scribe line 91 marks the depth to which sockets 23 are to be cut into the tail board 25.

Next, the tail board 25 is positioned on auxiliary table 50, such that the end of tail board 25 is against wood face 55. At this time, bolts 62 and nuts 63 holding back fence 52 in position may be loosened so that back fence 52 may be slid rearward or forward in order to align the scribe line 91 directly under long parallel wall 17*a*. The purpose of this alignment is to ensure that trapezoidal mortising chisel 10 does not cut behind the scribe line 91. After positioning back fence 52, bolts 62 and nuts 63 are re-tightened to hold back fence 52 in position. Tail board 25 is then temporarily secured to auxiliary table 50 by means such as clamp 42. The position of tail board 25 on auxiliary table 50 is chosen such that trapezoidal mortising chisel 10 is positioned directly above the place at which a socket 23 is to be cut in tail board 25. It will be observed that, since the narrower parallel wall 17*c* is positioned toward the rear of auxiliary table 50, the socket to be cut by trapezoidal mortising chisel 10 will be narrower toward the end E of tail board 25, and wider toward the interior of tail board 25, as shown in FIG. 2.

Next, the motor of drill press 30 is turned on, and power head 31 is moved downward toward tail board 25. Drill bit 16 cuts a circular hole in tail board 25, while, at the same time, cutting edge 14 is pushed down into tail board 25 to cut a trapezoidal socket 23 in tail board 25. (The purpose of cutting a circular hole with drill bit 16 is to aid in the cutting process; no circular shape remains once the cutting process is complete.) Once cutting edge 14 has descended all the way through tail board 25, power head 31 is raised away from tail board 25. Tail board 25 is then unclamped from the auxiliary table and moved into position to cut the next socket 23. If different pitches have been selected for the different sockets 23, the trapezoidal mortising chisel 10 may be removed at this time from the power head 31 and replaced with one having a different pitch. The process of cutting sockets 23 with trapezoidal mortising chisel 10 is then repeated until all sockets 23 have been cut in tail board 25.

Figure 15:
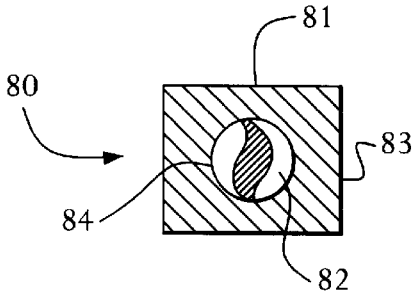
FIG. 15 is a sectional view of the square mortising chisel shown in FIG. 14, taken along line 15—15.
Figure 17:
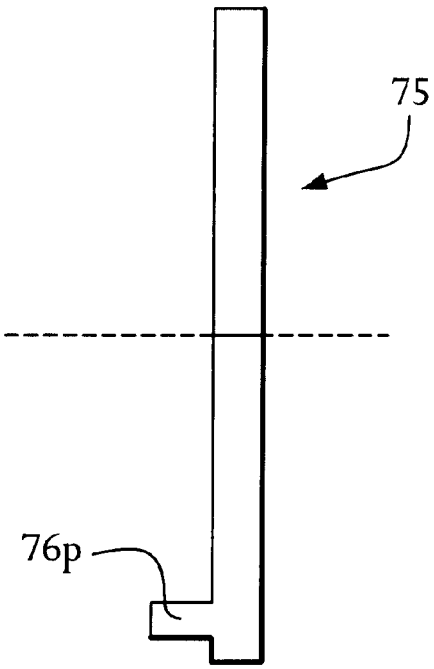
FIG. 17 is a side plan view of the washer shown in FIG. 16.
Figure 16:
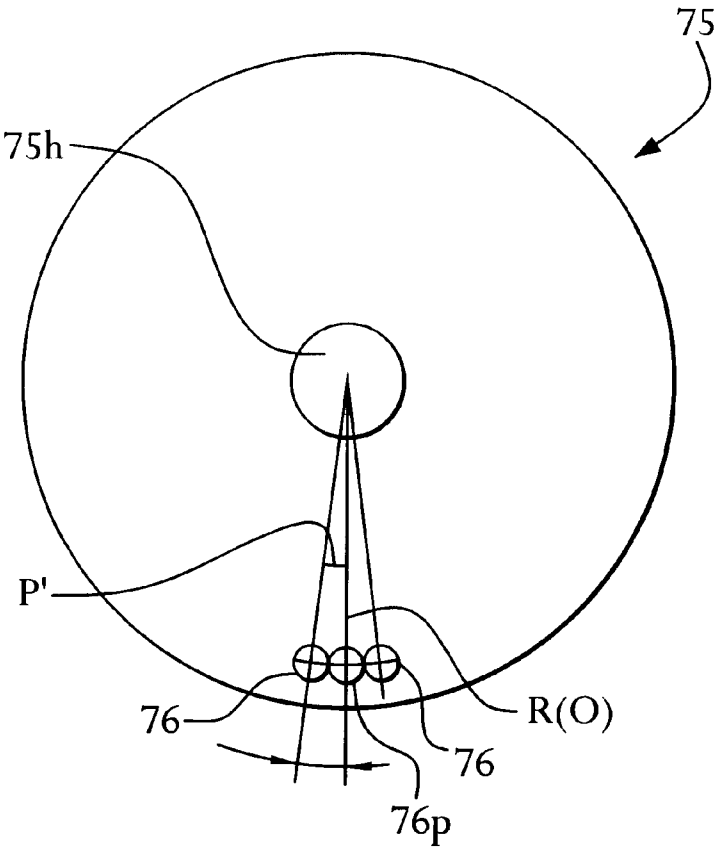
FIG. 16 is a plan view of a washer with holes and a pin, used as a tilt-aligner mechanism in accordance with aspects of the invention.

After sockets 23 have been cut in tail board 25, tail board 25 is removed from auxiliary table 50, so that pin board 26 may be cut. A scribe line 92 may be marked on pin board 26 representing the thickness of the tail board 25; scribe line 92 marks the depth to which sockets 24 are to be cut into pin board 26. When lap dovetails are being made, a lap scribe line 93 may be marked on pin board 26, representing the maximum thickness to which sockets 24 should be cut. Additional marks (not shown) may be made on pin board 26 to show where the sockets 24 should be cut to correspond to the positions of tails 21 on tail board 25, so that each tail 21 will have a socket 24 in the appropriate place into which to be inserted. Additionally, trapezoidal mortising chisel 10 is removed from power head 31, and is replaced with a standard square mortising chisel 80, which comprises a guide tube 81 and a drill bit 82. Guide tube 81 is defined by a square outer surface 83 and a circular inner surface 84. Square mortising chisel 80 is similar to trapezoidal mortising chisel 10, except that the perpendicular cross section of guide tube 81, shown in FIG. 15, is square instead of trapezoidal. The reason for changing to a square mortising chisel 80 to cut the pin board 26 can be appreciated with reference to FIGS. 1 and 3. As shown, the sides of pin sockets 23 in tail board 25 are slanted as the socket proceeds from the end E of the tail board 25 to its interior; the tail sockets 24 in pin board 26, however, are straight as the socket proceeds from the end A of the tail board 26 to its interior, but are slanted as the socket 24 proceeds from one side B of tail board 26 to the other side C. During the process of cutting pin board 26, pin board 26 lays with its side C against auxiliary table 50, with side B directly below square mortising chisel 80. Therefore, the slant on the tail sockets 24 in pin board 26 are not provided by the shape of the mortising chisel, but rather by the tilt of the work table 33 while the sockets 24 are being cut, as discussed below.

Drill press assembly 30 is fitted with washer 75 as discussed above, and work table 33 is tilted to an angle P', which corresponds to the pitch P of the trapezoidal mortising chisel 10 that was used to cut the tail board 25 (i.e., angle P is congruent to angle P'). Washer 75 is used in combination with alignment pin 79 to align work table 33 at the appropriate angle P', and bolt 71 is tightened to holt work table 33 at that angle P'. It will be recalled that washer 75 has holes 76 which are positioned so as to align work table 33 at an angle P' corresponding to the pitch of the trapezoidal mortising chisel 10 that was used to cut the tail board. If different pitches have been selected for the various sockets 23 of tail board 25, it is then necessary to change to a different washer 75 during the cutting of the pin board 26, to put an appropriate slant on the socket 24 being cut. The key is that, when a particular socket 24 is being cut in pin board 26 to receive a particular tail 21, the side of the socket should be cut at the same angle as the side of the socket 23 that was cut in tail board 25 to define the tail 21, so that the tail 21 and the socket 24 will fit together.

Pin board 26 is mounted on auxiliary table 50 with clamp 42. Back fence 52 may be moved forward or rearward in the manner described above to ensure that sockets 24 will not be cut beyond scribe line 92. Pin board 26 is also positioned along back fence 52 such that square mortising chisel 80 is directly above the place where a socket 24 is to be cut. Once back fence 52 and pin board 26 have been appropriately positioned, pin board 26 is secured to auxiliary table 50 by means such as clamp 42. At this point, the power for drill press 30 is once again turned on and power head 31 is moved downward into pin board 26. If through dovetails are being made, square mortising chisel 80 is moved downward all the way through pin board 26 to cut all the way through it's thickness. On the other hand, if lap dovetails are being made, then square mortising chisel 80 is brought down only as far as the lap scribe line 93, so as not to cut through the lap 27 in pin board 26. Because work table 33 is at an angle P', the socket 24 cut by square mortising chisel 80 has a side with angle P', thereby producing the angled socket 24 shown in the pin board 26 depicted in FIGS. 1 and 3. Depending on the size of square mortising chisel 80 and the size of tail 21 to be inserted into socket 24, it may be necessary to make more than one pass with square mortising chisel 80 in order to cut a socket 24 of sufficient size to receive tail 21.

After a socket 24 has been cut, the tail board 26 is unclamped from auxiliary table 50 and moved to the next point where a socket 24 is to be cut, and the process of cutting a socket 24 with square mortising chisel 80 is repeated. In the case where sockets 23 in tail board 25 were cut with differently-pitched trapezoidal mortising chisels 10, it may be necessary at this time to adjust the angle of work table 33 to correspond to the slope needed for a particular socket 24.

The result of the above process is the tail board 25 and pin board 26 shown in FIG. 1 (for through dovetails) or FIG. 4 (for lap dovetails). The tails 21 are then fitted into tail sockets 24, and the pins 22 fitted into tail sockets 23, to join the two boards. Glue or other adhesive may be applied to further strengthen the joint.

It is noted that the foregoing examples have been provided merely for the purpose of explanation and are in no way to be construed as limiting of the present invention. While the invention has been described with reference to preferred embodiments, it is understood that the words which have been used herein are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art having the benefit of the teachings of this specification, may effect numerous modifications thereto and changes may be made without departing from the scope and spirit of the invention in its aspects.

I claim:

1. A system for forming a dovetail joint for joining a pin board and a tail board, said system useable with a drill press having a power head which provides both vertical force and rotational torque, said drill press having a tiltable work table, said system comprising:

a first trapezoidal mortising chisel having a guide tube and a drill bit, said guide tube having an outer surface with a cross-sectional trapezoidal shape, said trapezoidal shape having a pair of parallel sides and a pair of non-parallel sides, at least a first one of the pair of non-parallel sides being sloped at a first angle from a line perpendicular to the pair of two parallel sides, said first trapezoidal mortising chisel being mountable on said drill press whereby vertical force is applied to said first mortising chisel and whereby torque is applied to said drill bit, said first angle corresponding to a slope of a side of a first socket to be cut in said tail board; and a tilt-aligner mechanism mountable on said drill press which aligns said tiltable work table in a position tilted at said first angle, said drill press thereby being usable to cut sockets in said pin board with sides sloped at said first angle when a square mortising chisel is mounted on said drill press with said work table tilted at said first angle.

2. The system of claim 1, wherein said first angle is between 5 and 15 degrees.

3. The system of claim 2, wherein said first angle is 7 degrees.

4. The system of claim 1, wherein a second one of the pair of non-parallel sides of said cross-sectional trapezoidal shape is sloped at a second angle from a line perpendicular to the pair of parallel sides, said system further comprising a second tilt-aligner mechanism mountable on said drill press which aligns said tiltable work table in a position tilted at said second angle.

5. The system of claim 4, wherein said first angle is congruent to said second angle.

6. The system of claim 1, further comprising an auxiliary table, said auxiliary table being clampable to said work table, said auxiliary table comprising a slidable back fence, a replaceable wood face fixedly attached to said back fence, and a replaceable wood insert which serves as a base for a board to be cut on said auxiliary table.

7. The system of claim 1, further comprising:

a second trapezoidal mortising chisel having a second guide tube and a second drill bit, said second guide tube having an outer surface with a cross-sectional trapezoidal shape, the second guide tube trapezoidal shape having a second pair of parallel sides and a second pair of non-parallel sides, at least a first one of the second pair of non-parallel sides being sloped at a second angle from a line perpendicular to the second pair of parallel sides, said second mortising chisel being mountable on said drill press whereby vertical force is applied to said second mortising chisel and whereby said torque is applied to said second drill bit, said second angle corresponding to a slope of a side of a second socket to be cut in said tail board; and a second tilt-aligner mechanism mountable on said drill press which aligns said tiltable work table in a position tilted at said second angle, said drill press thereby being usable to cut sockets in said pin board with sides sloped at said second angle when said square mortising chisel is mounted on said drill press with said work table tilted at said second angle.

8. The system of claim 1, wherein said work table tilts about an axis, and wherein said tilt-aligner mechanism comprises a washer coaxially mountable to said drill press about said axis, said washer having a starting radius corresponding to said work table being in a non-tilted position, said washer further having a pair of holes located around said washer at points corresponding to said first angle relative to said starting radius.

9. The system of claim 1, wherein said pin board comprises a lap.

10. The system of claim 1, wherein said system further comprises said drill press, wherein said drill press comprises said tilt-aligner mechanism which allows said tiltable work table to be aligned at an angle of tilt corresponding to said first angle.

11. The system of claim 1, wherein an opening is formed in said guide tube through which wood chips may be ejected.

12. The system of claim 1, wherein said guide tube has a cylindrically-shaped inner surface having an axis and a radius, and wherein said drill bit comprises a shank and an auger, said auger having a wide end which extends beyond said radius at least at some point about said axis when said drill bit is mounted coaxially with the axis of the cylindrically-shaped inner surface.

13. A device for cutting sockets in the tailboard of a dovetail joint, said device comprising:

a guide tube having a cutting edge, said guide tube having an outer surface with a cross-sectional trapezoidal shape and an inner surface with a cylindrical shape; and a drill bit rotatably mounted inside said guide tube;

wherein said device is mountable to a source of power that provides vertical force to said device and torque to said drill bit.

14. The device of claim 13, wherein said source of power comprises a drill press.

15. The device of claim 13, wherein said trapezoidal shape is an isosceles trapezoid.

16. The device of claim 15, wherein said trapezoid comprises a pair of parallel sides and a pair of non-parallel sides, wherein each one of the pair of non-parallel sides is sloped at an angle from a line perpendicular to said two parallel sides, and wherein said angle is between 5 and 15 degrees.

17. The device of claim 16, wherein said angle is 7 degrees.

18. The device of claim 13, wherein an opening is formed in said guide tube through which wood chips may be ejected.

19. The device of claim 13, wherein the cylindrically-shaped inner surface has an axis and a radius, and wherein said drill bit comprises a shank and an auger, said auger having a tapered end which extends beyond said radius at least at some points when said drill bit is mounted coaxially with the axis of the cylindrically-shaped inner surface.

20. A method of using a drill press to cut a dovetail joint, said dovetail joint for joining a pin board and a tail board, said drill press having a power head and a tiltable work table, said method comprising:

using a first trapezoidal mortising chisel mounted on the power head of said drill press to cut at least a first group of one or more sockets in said tail board, said first trapezoidal mortising chisel having a guide tube and a drill bit, said guide tube having an outer surface with a cross-sectional trapezoidal shape, said trapezoidal shape having a pair of parallel sides and a pair of non-parallel sides, at least a first one of the pair of non-parallel sides being sloped at a first angle from a line perpendicular to the pair of parallel sides, said first angle corresponding to the slope of the sides of said first group of one or more sockets to be cut in said tail board, said step of using said first trapezoidal mortising chisel comprising using said power head to apply a vertical force to said trapezoidal mortising chisel and a torque to said drill bit;

tilting said work table to said first angle relative to a horizontal position; and using a square mortising chisel mounted on the power head of said drill press to cut sockets in said pin board, said step of using a square mortising chisel comprising using said power head to apply a vertical force to said square mortising chisel and a torque to said drill bit, said step of using a square mortising chisel occurring while said work table is tilted at said first angle.

21. The method of claim 20, wherein said first angle is between 5 and 15 degrees.

22. The method of claim 21, wherein said first angle is 7 degrees.

23. The method of claim 20, wherein a second one of the pair of non-parallel sides is sloped at a second angle from a line perpendicular to the pair of parallel sides.

24. The method of claim 23, wherein said first angle is congruent to said second angle.

25. The method of claim 20, wherein said step of using a first trapezoidal mortising chisel occurs prior to said step of using a square mortising chisel.

26. The method of claim 20, further comprising the steps of:

using a second trapezoidal mortising chisel mounted on the power head of said drill press to cut a second group of one or more sockets in said tail board, said second trapezoidal mortising chisel having a second guide tube and a second drill bit, said second guide tube having an outer surface with a cross-sectional trapezoidal shape, said second guide tube trapezoidal shape having a second pair of parallel sides and a second pair of non-parallel sides, at least a first one of the second pair of non-parallel sides being sloped at a second angle from a line perpendicular to the first pair of parallel sides, said second angle corresponding to the slope of the sides of said second group of one or more sockets to be cut in said tail board, said step of using said second trapezoidal mortising chisel comprising using said power head to apply a vertical force to said second trapezoidal mortising chisel and a torque to said drill bit;

tilting said work table said second angle from a horizontal position; and second using a square mortising chisel mounted on the power head of said drill press to cut sockets in said pin board, said second step of using a square mortising chisel occurring while said work table is tilted to said second angle.

27. The method of claim 20, wherein said pin board comprises a lap.

28. A method of cutting sockets in the pin board of a dovetail joint, said dovetail joint comprising a pin board and a tail board, said method comprising:

using a square mortising chisel mounted on a drill press to cut said sockets in said pin board, said drill press having a work table; and tilting said work table of said drill press to a first angle corresponding to the slope of the sides of said sockets, said step of using said mortising chisel taking place while said work table is tilted.

29. The method of claim 28, wherein a washer having a pin and holes is mountable on said drill press and said drill press has an alignment pin associated therewith, and wherein the act of tilting said work table comprises using said washer and said alignment pin to align said work table in a tilted position at said first angle.

30. The method of claim 29, further comprising the step of cutting sockets in said tail board with a trapezoidal mortising chisel having a guide tube and a drill bit and being mountable on a drill press, said guide tube having an outer surface with a cross-sectional trapezoidal shape, said trapezoidal shape having a pair of parallel sides and a pair of non-parallel sides, at least a first one of the pair of non-parallel sides being sloped at said first angle from a line perpendicular to the pair of parallel sides.

31. The method of claim 28, wherein said pin board comprises a lap.

32. In a drill press having: (a) a vertical column having a collar with a first collar hole and a second collar hole; (b) a work table attached to a disk, said disk having a first disk hole and a second disk hole, said disk being attachable to said collar by a bolt inserted through said first disk hole and said first collar hole; (c) an alignment pin associated with said drill press, said alignment pin being receivable in said second collar hole and said second disk hole; the improvement comprising:

a washer having a first washer hole, a starting radius, a washer pin located along said starting radius, and second and third washer holes, said second and third washer holes being disposed on opposing sides of said starting radius each at a first angle from said starting radius, said washer being mountable between said collar and said disk with said pin being received in said second collar hole, said bolt being received first through said first disk hole, next through said first washer hole, and next through said first collar hole;

wherein said alignment pin is receivable through said second disk hole and either of said second and third washer holes so as to align said work table at said first angle of tilt.

* * * * *